United States Patent [19]

Mattei et al.

[11] Patent Number: 4,710,257

[45] Date of Patent: Dec. 1, 1987

[54] DEVICE FOR THE APPLICATION OF AN ADHESIVE TO ONE OR MORE LOCALIZED AREAS OF A SHEET OF FLEXIBLE WRAPPING MATERIAL

[75] Inventors: Riccardo Mattei; Alessandro Minarelli, both of Bologna, Italy

[73] Assignee: G. D. Societa Per Azioni, Bologna, Italy

[21] Appl. No.: 802,461

[22] Filed: Nov. 27, 1985

[30] Foreign Application Priority Data

Nov. 29, 1984 [IT] Italy ..... 3637 A/84
Sep. 3, 1985 [IT] Italy ..... 3532 A/85

[51] Int. Cl.[4] ..... B65H 5/12

[52] U.S. Cl. ..... 156/578; 118/211; 118/221; 118/675; 271/276; 271/310; 271/311

[58] Field of Search ..... 156/578, 567, 568, 521; 271/196, 312–313, 307–308, 273, 274, 262–263, 310, 261, 112; 118/211, 212, 221, 231, 261, 675

[56] References Cited

U.S. PATENT DOCUMENTS 2,787,244 4/1957 Hickin ..... 118/212 X
2,877,737 3/1959 Taggart ..... 118/212
3,586,586 6/1971 Berg ..... 156/521
3,751,324 8/1973 Euskat ..... 156/578 X
3,991,708 11/1976 Huebschmann et al. ..... 118/212 X
4,285,507 8/1981 Marinoff ..... 271/308 X
4,533,135 8/1985 Barker ..... 271/273

FOREIGN PATENT DOCUMENTS 446558 5/1936 United Kingdom .
1143660 2/1969 United Kingdom .

*Primary Examiner*—David Simmons
*Attorney, Agent, or Firm*—Cushman, Darby & Cushman

[57] ABSTRACT

The device comprises a glue roller which picks up adhesive from a tray or tank, a scraper that wipes the glue roller, leaving the adhesive at prescribed points only, and a contact roller which takes sheets of wrapping material through an area where adhesive is applied to them. The contact roller is disposed about an axis parallel to the axis of the glue roller through positioned downstream thereof in the direction of movement of the sheets, such that a guide may be located beneath the contact roller adjacent to the cladding of the roller, designed to afford support to sheets carried by the contact roller and existing from the area where the adhesive is applied.

10 Claims, 6 Drawing Figures

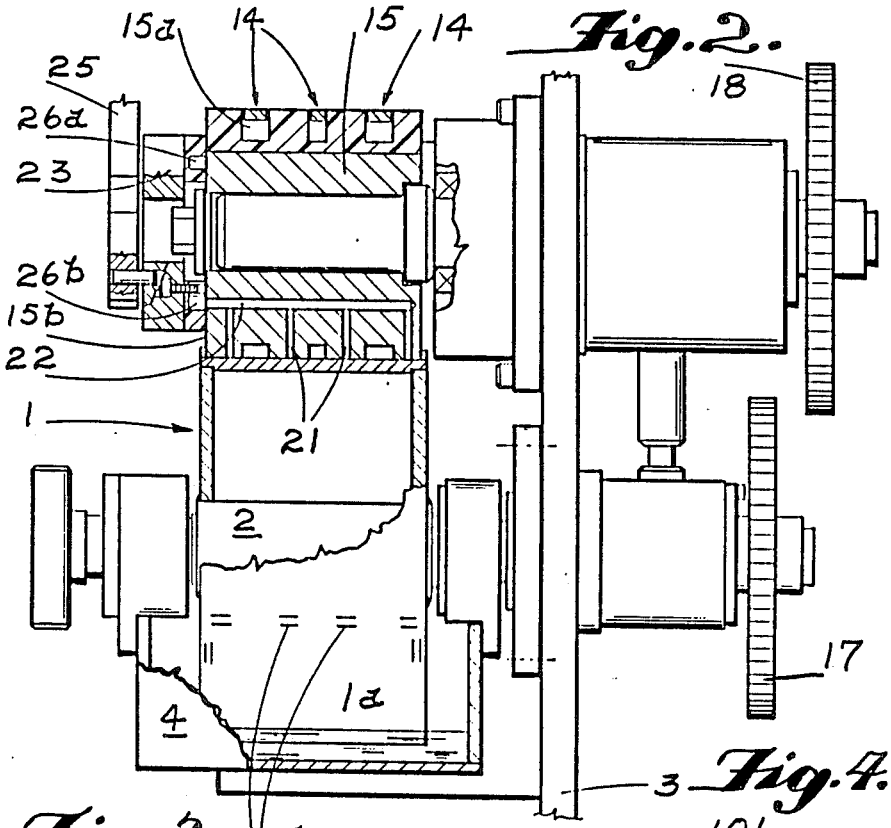
Fig. 2.
Fig. 3.
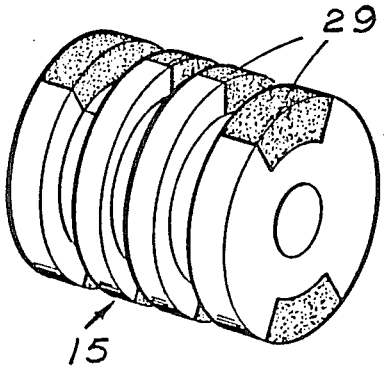
Fig. 4.
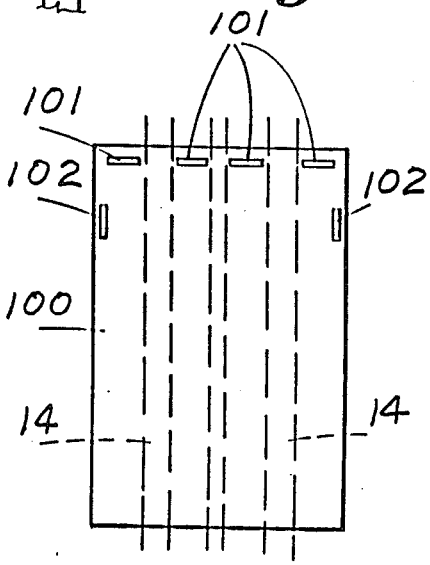
Fig. 5.
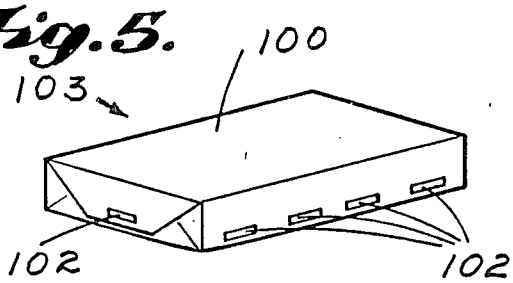

DEVICE FOR THE APPLICATION OF AN ADHESIVE TO ONE OR MORE LOCALIZED AREAS OF A SHEET OF FLEXIBLE WRAPPING MATERIAL

BACKGROUND OF THE INVENTION

The invention herein relates to devices for the application of adhesive, glue, that is, to one or more defined areas on a wrapping material, and in particular, on sheets or lengths of such material as are used for wrapping products of a prismatic shape, such as soaps, packs of cigarettes or similar articles packaged utilizing automatic wrapping machines.

In such machines, the sheets or lengths of wrapping material are conveyed in rapid succession to a wrapping station simultaneously with the single articles for packaging. During their progress toward the wrapping station, the sheets of material are provided with an adhesive at least along one side, and at one or more localized areas, which permits subsequently of fastening the wrappings formed by such sheets.

In prior art machines, the adhesive is contained in a tray or tank, and transfer of the adhesive to the sheet of wrapping material is performed by rotary components such as, for instance, channelled rollers, or coaxial disks (applicators) set apart one from the next to match the distance between centres of those localized areas on the sheet of wrapping material to which the adhesive must be applied.

Metering of the adhesive picked up by such rotary components in prior art machines is accomplished by fixed position scrapers.

These fixed position scrapers, clearly, are located upstream of the point where application of the adhesive to the sheet of wrapping material is brought about, and are generally contoured so as to breast with the front and lateral surfaces of those parts of the applicator disks that are in relief, in order to remove the adhesive substance from all such parts as might foul the sheet of wrapping material during application.

The match between the scraper and channelled roller (or applicator disks) must be particularly accurate in order to prevent the formation of voids, particularly near the corners, which would result in failure to remove a quantity of adhesive considerably in excess of that required, with the consequence that the following application of adhesive to the sheet of material may be marred by splashes or traces of glue falling outside the envisaged localized areas of the sheet.

It has been found in practice that considerable servicing is required in the prior art devices thus described in order to ensure efficient operation of the scrapers, particularly of their action against those lateral surfaces of parts of the channelled rollers or applicators that are in relief.

It happens frequently that, owing to wear or to the accumulation of encrustations which are not speedily removable, the scrapers must be replaced, and considerable amount of time is lost in adjusting them with respect to the parts to be wiped.

Devices of the type mentioned above have been seen to be suitable for the application of adhesive to sheets of wrapping material having a certain consistency, such as sheets of thin card, for example, though unsuitable for thin and flexible sheets of material such as those utilized for soft-packaging cigarettes (American wrappings). In this instance the sheet tends to crease at those points which remain unsupported during application of the adhesive, a situation which can give rise to faulty transfer of the adhesive, bringing with it the risk of runs into unwanted areas, and at all events of an excessive deposit of the adhesive along the side-edges of the localized areas of the sheet of wrapping material.

With the above in mind, it will be remembered that in order to receive the adhesive from the glue rollers or disks, the sheets of wrapping material are usually urged against such rollers and/or disks by contact rollers, which work in conjunction therewith.

It is the action thus produced which tends to give rise to the creasing aforementioned, especially in the case of sheets of extra-thin, hence extremely flexible material.

In other prior art systems, the rotary component that transfers adhesive from the tray or tank to the sheets of wrapping material consists of a roller the cladding of which incorporates pockets that are located according to the position of the localized areas of the sheet of wrapping material onto which the adhesive is to be transferred.

In order to keep the cladding of the roller clean, a fixed scraper is provided the function of which is to wipe the outer surface of the cladding, thoroughly, in such a way that adhesive picked up by the roller will remain in the pockets only.

During transfer of the adhesive from the glue roller to the wrapping material, a contact roller urges the sheet against the glue roller, (cleaned continuously by the scraper) such that at least a part of the adhesive contained in the pockets is transferred onto the sheet of wrapping material at the envisaged localized areas.

With this system, it becomes possible to dispense with the use of contoured scrapers such as are required for devices of the channelled roller or the side-by-side disk applicator type, and one has the advantage of being able to use a scraper having a practically linear edge which rests against the outer surface of the roller cladding and is easily adjustable in relation to this surface, providing optimum conditions of cleanliness at all times. What is more, the problem of creasing in the sheet of wrapping material is practically eliminated, since the entire width of the sheet rests against the outer surface of the roller cladding at the point where it is brought into contact. Nonetheless, when required to handle thin and extremely flexible sheets of material, it happens likewise in this instance that such devices are difficult to use in practice, and for a number of reasons.

The roller does not have circumferential channels; as a result there is no space available between the glue roller and the contact roller where guides can be located so as to take up the sheet of wrapping material exiting from the point at which the adhesive is applied. This poses no particular problem in the case of sheets of wrapping material having a certain consistency, since their own relative flexibility causes them to separate automatically from the glue roller and continue forward onto guides positioned downstream of the roller itself; for thin and highly flexible sheets of material however, devices of this type cannot be employed other than with great difficulty in terms of operation, due to the fact that the sheet of wrapping material exiting from the device tends to cling to the glue roller and thus follow a trajectory other than would be optimum. Such clinging is caused by a film of glue which remains on the outer surface of the roller, despite the action of the scraper.

This negative effect can occasion blockage of the device and cause the sheet to stick against the guides, so that shutdown of the machine is required in order to restore normal operating conditions.

The main object of the invention is that of providing a device for the application of adhesive to one or more localized areas of a flexible sheet of wrapping material, designed in such a way as to eliminate the disadvantages produced in similar prior art devices, and affording the possiblity of handling extremely flexible wrapping, with no risk whatever of the sheet of wrapping material clinging to the glue roller.

A further object of the invention is that of providing a device of the type in question, wherein the possibility exists of incorporating guides which take up the sheet as it exits from the device itself, located in such a way as to ride the outer surface of the glue roller in close proximity to the point where the adhesive is transferred from the glue roller to the sheet of wrapping material, and positioned so as to afford uninterrupted support to the exiting sheet without any risk of its sticking fast or becoming diverted from its path.

SUMMARY OF THE INVENTION

The stated objects are realized with a device such as that to which the invention relates -viz, a device for the application of an adhesive to one or more localized areas of a sheet of flexible wrapping material, comprising a glue roller having either a one piece or a sectional cladding which picks up adhesive from a tray or tank, and at least one scraper located in contact with the outer surface of the roller cladding, positioned upstream of the point where adhesive is applied to the sheet of wrapping material and performing a thorough cleaning action on the outer surface of the cladding such that adhesive remains only in localized areas, wherein a contact roller lying tangential to the glue roller at the point of application of the adhesive serves to transfer the sheet from an infeed point, located upstream of the point of application in relation to rotation of the contact roller, to a release point downstream of same at which sheets are taken up from the contact roller by a guide positioned adjacent thereto, and wherein the contact roller is provided with internal galleries that communicate with its cylindrical surface and connect by way of a chamber, located between the infeed point and the release point, with means of generating suction.

Such an arrangement offers features that will bring advantages, not only in those instances where the glue roller consists of a single cylinder having a substantially smooth surface, but also in those where the glue roller is embodied as a set of coaxial disks.

The arrangement described, in effect, creates the option of separating sheets from the glue roller by exploitation of the contact roller which, handling the sheets delicately, despatches them along fixed guides to the take-up and infeed means serving the packaging line.

With the contact roller displaced downstream of the glue roller in the direction of rotation of the glue roller, one has the advantage over prior art methods of a reduction in the distance between the point where sheets are released, and the point where take up means are located, a reduction in distance which is the more advantageous where particularly small sheets are being utilized.

An additional feature of the device is that the chamber associated with the contact roller is divided into two separate sections isolated one from the other, both of which communicate with the means of generating suction, the chamber section positioned upstream (in relation to the rotation of the contact roller) communicating with such means of generating suction by way of a valve; the device also comprises means of control incorporating at least one transducer located at a point along guide means that take up the sheets on exit from the glueing device, which will verify the proximity and/or correct position of each sheet of wrapping material, and trigger operation of the valve (to close) and shutdown of the work station or machine downstream of the device, as well as distancing at least one of two opposed components that make up the guide means, from the other.

The advantage of such features is, that where incorrect conditions exist such as when the sheets of wrapping material become jammed, or retard at a given point with respect to preset operating times, or are less than perfectly aligned in relation to the guide means, the machine downstream of the device shuts down, and infeed of the sheets to the glue roller ceases before conditions are allowed to deteriorate further, and even before the operator becomes aware of the malfunction.

Furthermore, separation of the guide means permits of restoring correct operating conditions in a markedly short time.

BRIEF DESCRIPTION of the DRAWINGS

The invention will now be described by way of example with reference to the accompanying drawings in which:

FIG. 2 is a schematic representation of the device as in FIG. 1, seen in front elevation from the viewpoint denoted A in FIG. 1, and with certain parts cut away better to reveal others;

FIG. 3 is a schematic representation, strictly guideline in nature, of one possible embodiment of the contact roller designed to assist transfer of the adhesive from the glue roller to the sheet of wrapping material;

FIGS. 4 and 5 are the respective illustrations of a possible type of sheet of wrapping material, and of a parallelepiped package obtained with such a sheet;

DESCRIPTION OF THE PREFERRED EMBODIMENTS

Figure 1:
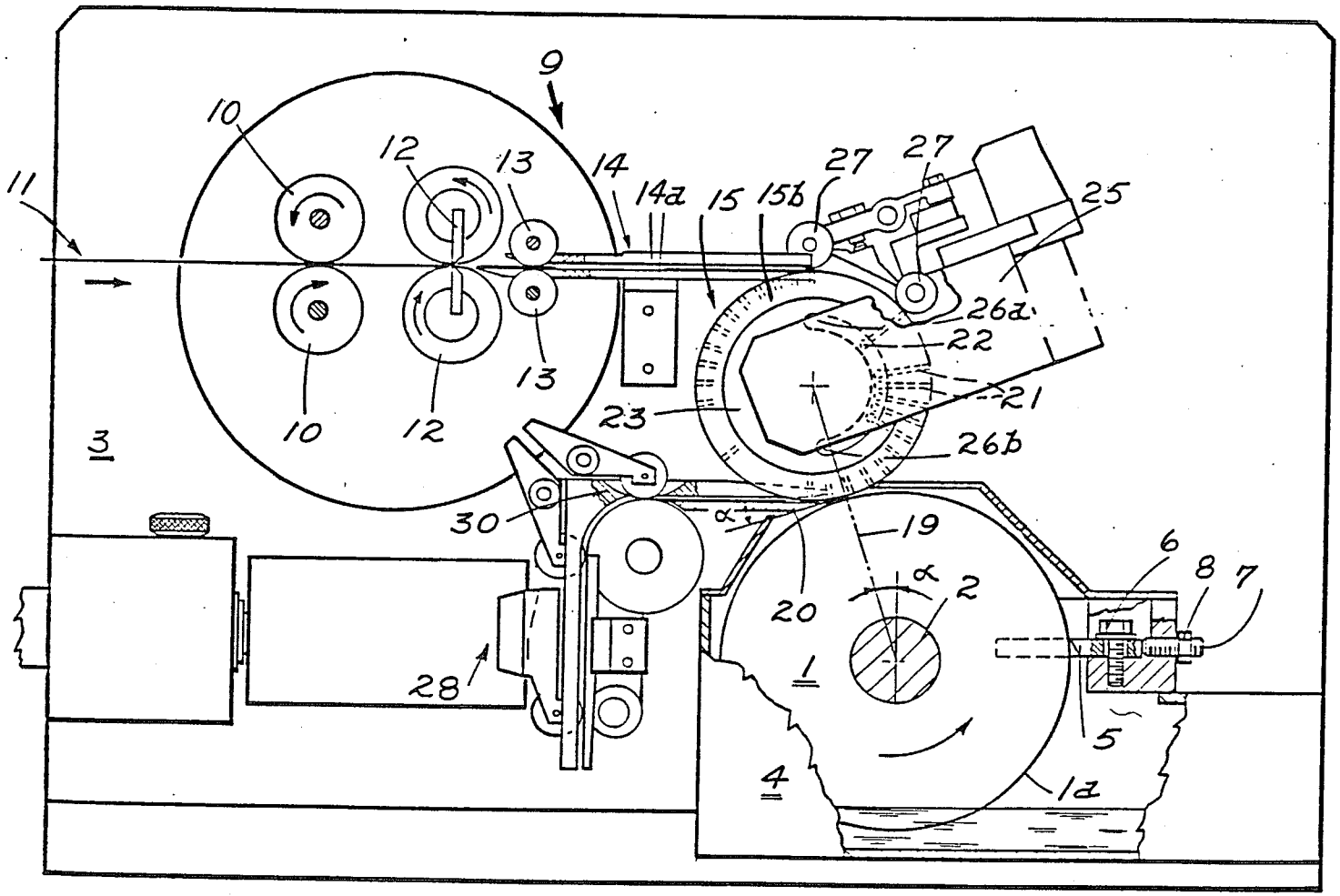
FIG. 1 is the schematic representation of a first embodiment of the device described herein, seen in side elevation.

As embodied in FIGS. 1 and 2, the device comprises a roller 1, referred to throughout as the glue roller, keyed to a shaft 2 which is journalled to the main frame 3 of the device.

The roller 1 is mounted within a tray or tank 4 containing adhesive, say, glue in the liquid state. The tray 4 is also supported by the frame 3.

It will be seen in FIG. 2 that the cladding 1*a* of the roller 1 exhibits a set of pockets 1*b* in its outer surface, the purpose of which will become clear in due course; the pockets 1*b* in question are located in positions that match those of localized areas on the sheet of wrapping material to which adhesive must be applied, as in FIG. 4, for example, where a sheet or length of wrapping 100 is illustrated with such areas 101 and 102 located at points of application which are ideally positioned to form a package 103 of parallelepiped shape, as in FIG. 5.

The tray 4 in its turn supports a scraper 5 which is substantially U-shaped and proportioned such as to make contact with the cladding 1*a* of the glue roller 1 along its entire length and across a limited stretch of its ends. The scraper 5 is fixed to the tray 4 with bolts 6 (one only of which is visible in FIG. 1), and can be adjusted in relation to the surface of the cladding 1*a* by way of set screws 7 (one only of which is visible in FIG. 1) locked in position with relative nuts 8.

9 denotes an infeed line supplying sheets 100 to the device in ordered succession.

Such a line might comprise, for instance, a pair of counter-rotating drive rolls 10 by means of which a continuous strip 11 of wrapping material can be wound off a reel (not illustrated) and propelled toward a pair of rotary cutters 12 that divide the strip 11 into single sheets or lengths 100.

The infeed line 9 comprises a further pair of counter-rotating rolls 13, downstream of the pair of cutters 12, ejecting the sheets 100 onto a runout 14 that carries them away from the line 9. All parts of the line 9 thus indicated are supported by the main frame 3 of the device. The runout 14 is formed of a set of laths 14*a* (FIG. 2) located side by side and set apart one from the next such as to alternate with the localized areas 101 of the sheet of wrapping material 100 (broken lines of FIG. 4 represent the laths 14*a* of the runout 14).

The device comprises a contact roller 15 situated at the end of the runout 14, keyed to a shaft 16 that lies parallel with the glue roller shaft 2 and is journalled in like manner to the main frame 3. The contact roller 15 exhibits a given number of circumferential grooves 15*a* (see FIG. 2) that are designed to accommodate the laths 14*a*; sheets 100 coming off the runout 14 are thus able to settle easily onto the cylindrical surface of the contact roller 15 since there is no break in continuity between the surface offered by the laths 14*a* and the surface offered by the contact roller 15. The contact roller 15 is made to rotate in the opposite direction to that of the glue roller 1, and drive transmitted to the shaft 16 of the contact roller 15 and to the shaft 2 of the glue roller 1 is appropriately routed from a shaft of the machine into which the device is integrated, by way of kinematic linkages terminating in gears 17 and 18 keyed to the rear ends of the two shafts 2 and 16 (see FIG. 2).

The straight line generator through which the contact roller 15 and glue roller 2 make contact lies within an axial plane 19 that is common to both, and raked in the direction of rotation of the roller 1 such as to create an acute angle a with its vertical axial plane. 20 denotes a horizontal guide located beneath the contact roller 15 and at a level lower than that of the straight line generator, the entry end of which lies substantially tangential to the outer surface of the glue roller cladding 1*a*.

This guide 20, which forms an acute angle a with a plane passing through the aforesaid straight line generator at right angles to the raked plane 19, affords solid support to the sheet 100 exiting from the device onto the guide 20, with no risk of its sticking fast. The guide 20 might be a platform type of width to match the length of the glue roller 1, or it may be formed from a number of slats side by side; whatever the ultimate embodiment, it will be located between the glue roller 1 and the contact roller 15 as indicated, externally of their line of contact.

In order that sheets of wrapping material 100 may be conveyed from the end of the runout 14 round toward the glue roller 1, the contact roller 15 incorporates a series of radial bores 21, arranged in rows parallel with the axis of the contact roller 15 itself and emerging at those parts of its cylindrical surface which take up the sheets (see FIGS. 1 and 2). The bores 21 of each row connect internally of the contact roller 15 with a corresponding gallery 22. One end of the internal gallery 22 relative to each row of bores 21 remains open, thereby creating inlet ports all of which are grouped at one end 15*b* of the contact roller 15 (see FIGS. 1 and 2) and disposed about a circumference concentric with the axis of rotation of the contact roller 15.

23 denotes a flanged breasted airtight with the end 15*b* of the contact roller 15, comprising a seal 24 and supported fixedly by an arm 25 fitted to the main frame 3. That section of the flange 23 which is circumscribed by the seal 24, and breasted with the end 15*b* of the contact roller 15, incorporates a chamber 26 in the form of a circular arx extending through 180°, the median of which coincides with the inlet ports of the internal galleries 22. The chamber 26 communicates with means of generating of suction (not shown in the drawings), and is located with its entry end 26*a* upstream of the line 19 where contact occurs between the sheet 100 of wrapping material and the glue roller 1, and its exit end 26*b* immediately downstream thereof.

Completing the assembly of parts illustrated in the drawings, 27 denotes idle pressure rollers operating in concert with the contact roller 15, and 28 denotes a line which conveys sheets 100 exiting from the device toward other work stations of the machine into which the device itself is integrated.

A brief summary of the operation of the device now follows, with reference to the above description.

First, it will be realized that the cladding of the glue roller 1 may incorporate a number of sets of pockets 1*b* in order to allow of glueing several sheets 100 per single revolution of the roller. As aforementioned, sheets 100 exiting from the runout 14 come to rest on the contact roller 15 at a precise infeed point, assisted both by the rollers 27 nearest the runout 14 and by virtue of the fact that, at the moment in which the sheet 100 comes to rest on the contact roller 15, a row of the radial bores 21 will have arrived beneath the rollers 27 and thus be in communication with the aforementioned means of generating suction by way of the chamber 26.

The sheet 100 is thus caused to cling to the contact roller 15, which in rotating gradually brings other bores 21 into communication with the chamber 26 and ensures that the sheet 100 adheres to its cylindrical surface. At the same time, the glue roller 1 is rotated and picks up adhesive from the tray 4.

As adhesive is transferred steadily from the tray 4 to the sheet of wrapping material 100 carried by the contact roller 15, the outer surface of the glue roller cladding 1*a* and the ends of roller itself are wiped clean by the scraper 5; the outer surface of the cladding downstream of the scraper therefore remains totally clean and free of adhesive, with the exception of the pockets 1*b*. As mentioned beforehand, pockets 1*b* are located in the cladding of the glue roller 1 to match the position of the localized areas 101 and 102 of the sheet 100, and when first setting up the device, care must be taken that the sheet 100 arrives at its point of contact with the glue roller 1 correctly timed with arrival of the pockets 1*b* at the same point. On arrival at its point of contact with the glue roller 1, the sheet 100 will still be held tight against the contact roller 15 by virtue of the radial bores' 21 continuing to communicate with the means of generating suction 32.

As successive parts of the sheet 100 gradually cross the line of contact with the glue roller 1, which, it will be recalled, coincides with the plane denoted 19, their contact with the outer surface of the cladding, and more precisely, contact between the sheet 100 and the areas where the glue pockets **1*b* are located, is such that adhesive contained in the pockets is applied to the localized areas 101 and 102. In order to assist the process, the cylindrical surface of the contact roller 15 that takes up the sheet 100 exhibits a set of inserts 29 in resilient material, set slightly proud of the surface in positions which match those of the localized areas 101 and 102 so as to mate with the pockets 1*b* through the line of contact between sheet 100 and glue roller 1**.

As the sheet 100 gradually passes beyond the line of contact with the glue roller, the internal galleries 22, passing likewise beyond the line, leave the chamber 26; the result is that the suction which hitherto held the sheet 100 to the contact roller 15 is cut off, and the sheet drops by degrees onto the guide 20 at the aforementioned release point, from where it is conveyed gradually toward the line denoted 28.

With reference to this line 28, the guide 20 may be supplemented by a number of laths 30, similar to the laths **14*a* making up the runout 14, positioned above the guide 20 itself with their entry ends located in the grooves 15*a* of the contact roller 15 at a point diametrically opposed to that at which the ends of the runout laths 14*a*** are located.

Figure 6:
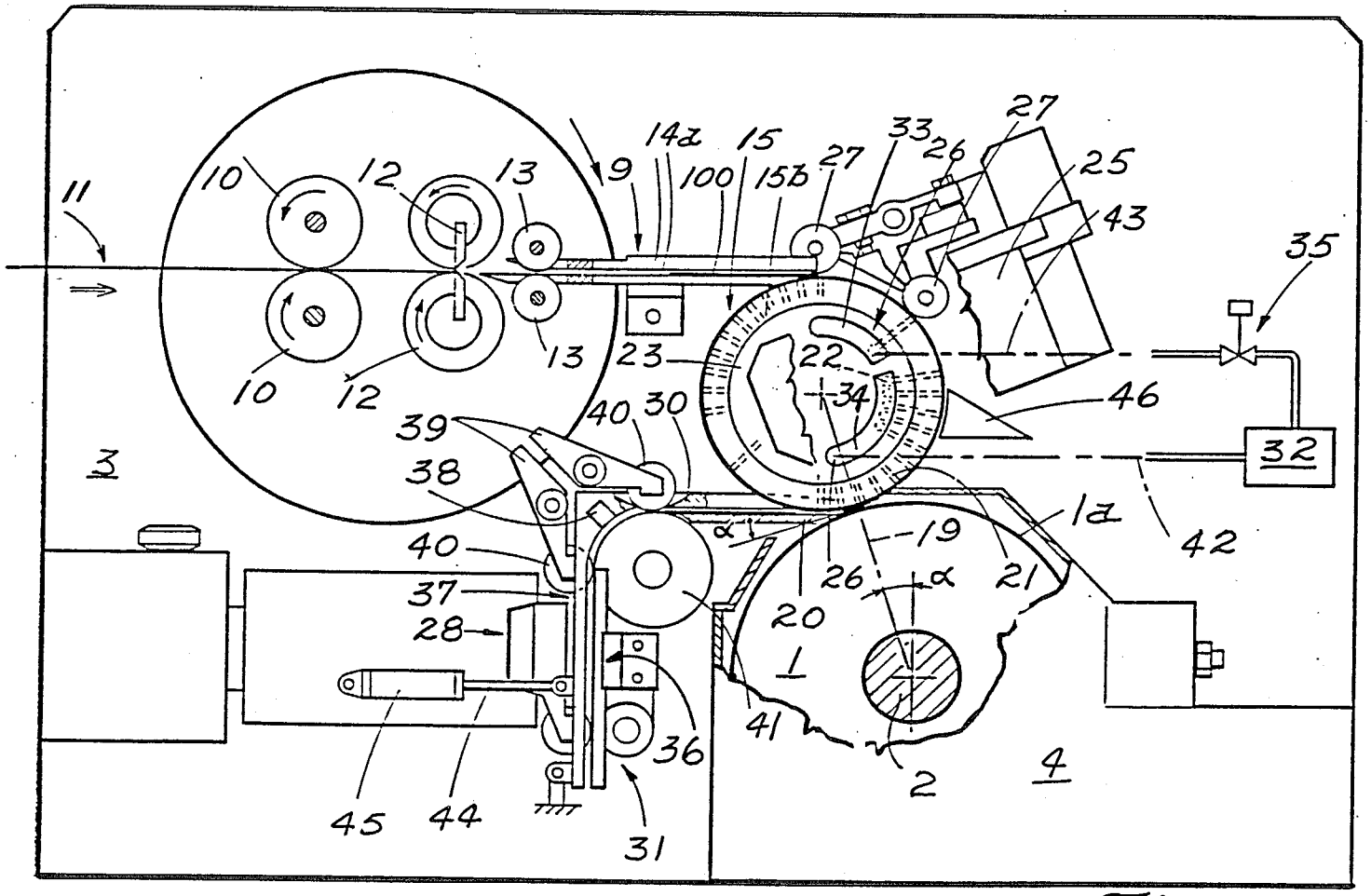
FIG. 6 is the schematic representation of a second embodiment of the device described herein, seen in side elevation.

With reference to FIG. 6, which illustrates a second embodiment of the device, the chamber 26 in the flange 23 that breasts with the contact roller is divided into two sections, denoted 33 upstream and 34 downstream in relation to the direction of rotation of the contact roller 15, both of which connect, by way of respective air-lines 43 and 42, with the means of generating suction 32. The air-line denoted 43 is provided with a valve 35 the purpose of which will become clear in due course.

The guide 20 and the laths 30 together form an assembly 37 which together with a further guide component denoted 36 goes to make up the guide means 31 that constitute the line denoted 28.

As FIG. 6 shows, the horizontal guide 20 and the guide component 36 form a right angle path via which sheets 100 are fed to successive work stations operating in a vertical axis; the guide component 36 is associated with a diverter roll 41 designed to convey the sheets 100 without any break in continuity from the moment of their leaving the support afforded by the guide 20 to that of their making contact with the guide component 36. The laths 30 are in the form of an upturned L with an internal angle contoured to match the diverter roll 41, and support two sprung rocker levers 39, each pivoting about a respective fulcrum and carrying an idle roller 40 at one end. The idle rollers 40 are spring-loaded to urge against the diverter roll 41 at two points set apart through 90° in relation to the axis of the diverter roll 41 itself.

35 denotes a shut-off valve on the air-line 43 connecting the upstream chamber 33 with suction 32, which is operated by means of control comprising a transducer 38 integral with the laths 30 of the guide assembly 37 and located in a substantially central position between the idle rollers 40 carried by the levers 39. The transducer 38, for instance, an emitreceive photocell using optic fibres, is designed to detect proximity and correct positioning, at least of the leading edge, and preferably of the trailing edge as well, of all the sheets 100 as they pass beneath spaced slightly apart one from the next.

The guide assembly 37 comprising the laths 30, together with the levers 39 and their relative idle rollers 40, is pivoted at its bottom end to the main frame 3 of the device. 44 denotes the rod of an actuator the end of which is hinged to the assembly 37; the actuator itself is a conventional cylinder 45, pneumatic for example, likewise mounted to the main frame 3 and operated by means of control which are governed by the transducer 38. Thus, one component 36 of the guide means 31 remains stationary whereas the assembly 37 is movable.

This second embodiment further comprises a diverter 46 supported by the main frame 3 and located alongside the contact roller 15 between the infeed point where sheets 100 join the contact roller 15 and the release point where sheets pass from the roller to the guide 20. The diverter 46 is set sufficiently close to the contact roller 15 to satisfy a requirement which will become apparent, whilst sheets 100 carried by the contact roller 15 are allowed to pass between the roller 15 and the diverter 46 without any possibility of their jamming.

A brief summary of the operation of the second embodiment of the device now follows, with reference to the foregoing, and to FIG. 6.

The sheet 100 clings to the contact roller 15, which in rotating brings the suction bores 21 into communication with the chamber 26 in steady succession and ensures that the sheet 100 adheres to its cylindrical surface. Meanwhile, the glue roller 1 is rotated and picks up adhesive from the tray 4.

As adhesive is transferred steadily from the tray 4 to the sheet of wrapping material 100 carried by the contact roller 15, the outer surface of the glue roller cladding **1*a* and the ends of roller itself are wiped clean by the scraper 5**.

As successive parts of the sheet 100 gradually cross the line of contact with the glue roller 1 (coinciding with the raked plane 19), contact between the sheet 100 and the glue roller cladding **1*a* causes adhesive contained in the pockets 1*b* to be applied to the localized areas 101 and 102** of the sheet.

As the sheet 100 gradually passes beyond the line of contact with the glue roller, the internal galleries 22 likewise pass beyond the line and leave the chamber 26, with the result that suction which hitherto held the sheet 100 to the contact roller 15 is cut off, and the sheet drops by degrees onto the guide 20 at the aforementioned release point, from where it is conveyed gradually toward the line denoted 28 and consituted by the guide means 31.

The above operations will continue regularly in the manner described, as long as the transducer 38 continues to register the proximity and the correct position of the leading edge of each sheet 100 that passes beneath, and of the trailing edge too where possible, within a given time-limit. Should proximity -say, of the leading edge of a sheet 100, fail to be detected at the prescribed moment, however, then the transducer 38 will trigger a shutdown in operation of the work station or machine positioned downstream of the device, via the means of control that it governs. At the same time, the transducer 38 will cause the shut-off valve 35 of the air-line 43 serving the upstream section 33 of the chamber 26 to close, and actuate the cylinder 45.

The upshot of these steps triggered by the transducer 38 is that the movable assembly 37 is distanced from the fixed component 36 to permit removal of the jammed sheet or sheets 100, and the contact roller 15 no longer carries sheets 100 fed in from the line 9 around to the glue roller 1, but for as long as it takes for the machine to reach a complete standstill, deposits them on the diverter 46 which in turn draws them away from the device.

Once the jammed sheets 100 are removed, the operator can restart the device. The work station or machine downstream likewise restarts, the movable assembly 37 returns toward the fixed component 36 to reset the line 28, and the shut-off valve 35 is reopened in order to re-connect the upstream section 33 of the chamber 26 with suction 32.

During the interim prior to full restoration of correct operating conditions, the transducer 38 will remain disexcited for a given number of cycles, calculated on the basis of the length of a sheet 100, and the distance it covers along the route from the first pressure roller 27 round to the transducer 38. Accordingly, the means of control will relay a signal forward to the downstream work station or machine for reject of those products that fail to receive their sheet 100 of wrapping material.

A useful modification falling within the scope of the invention as claimed would be that of supporting the fixed guide component 36 on slides; in this instance the cylinder 45 could distance the movable assembly 37 from the fixed component 36, causing it to move, for example, through a direction such as to create an angle of 45° with the arms of the contoured laths 30.

Again, the movable assembly 37 might be split in two parts substantially at the location of the transducer 38, and these parts made to move obliquely in relation to one another.

The device might be embodied in a number of such variants, all of which fall within the scope of the inventive idea. Instead of one transducer 38, for example, a set might be utilized, ranged along a line at right angles to the direction of movement of the sheets 100 and designed to detect whether or not the sheets advance with their leading edge perfectly at right angles to the direction of movement, and if not, to trigger knock-out of the product to which the incorrectly positioned sheet 100 is allocated, in the event of a single occurrence, or to trigger the steps already described for a break in sheet infeed, in the event that such incorrect alignment persists.

In practical application, the device thus disclosed can be incorporated into a power machine for the packaging of single products as illustrated in FIGS. 1 and 2, or alternatively, positioned such that the guide 20 is angled, or even vertical, whilst the horizontal position of the tray 4 remains unaltered.

What is claimed is:

1. A device for the application of an adhesive to one or more localized areas of a sheet of flexible wrapping material, comprising a glue roller having either a one-piece or a sectional cladding which picks up adhesive from a tray or tank, and at least one scraper located in contact with the outer surface of the roller cladding, positioned upstream of the point where adhesive is applied to the sheet of wrapping material and performing a thorough cleaning action on the outer surface of the cladding such that adhesive remains only in localized areas, wherein a contact roller lying tangential to the glue roller at the point of application of the adhesive serves to transfer the sheet from an infeed point, located upstream of the point of application in relation to rotation of the contact roller, to a release point downstream of same at which sheets are taken up from the contact roller by a guide positioned adjacent thereto, and wherein the contact roller is provided with internal galleries that communicate with its cylindrical surface and connect by way of a chamber, located between the infeed point and the release point, with a means of generating suction, wherein the glue roller and the contact roller make contact with one another through a straight line generator lying in a plane that coincides with the axis of the glue roller and is raked in the direction of rotation thereof, so as to form an acute angle with a vertical axial plane passing through the self-same glue roller, and further wherein the guide takes up the sheet as it exits from the device itself, located in such a way as to ride the outer surface of the glue roller in close proximity to the point where the adhesive is transferred from the glue roller to the sheet of wrapping material, and positioned so as to afford uninterrupted support to the exiting sheet without any risk of its sticking fast or becoming diverted from its path.

2. Device as in claim 1, wherein the guide is disposed substantially tangential to the contact roller at the release point.

3. Device as in claim 1, wherein the cylindrical surface of the contact roller incorporates a set of inserts in resilient material set slightly proud of that surface, in positions matching those of the localized areas of the sheet of material onto which adhesive is to be transferred.

4. Device for the application of an adhesive to one or more localized areas of a sheet of flexible wrapping material, comprising a glue roller having either a one-piece or a sectional cladding which picks up adhesive from a tray or tank, and at least one scraper located in contact with the outer surface of the roller cladding, positioned upstream of the point where adhesive is applied to the sheet of wrapping material and performing a through cleaning action on the outer surface of the cladding such that adhesive remains only in localized areas, wherein a contact roller lying tangential to the glue roller at the point of application of the adhesive serves to transfer the sheet from an infeed point, located upstream of the point of application in relation to rotation of the contact roller, to a release point downstream of same at which sheets are taken up from the contact roller by a guide positioned adjacent thereto, and wherein the contact roller is provided with internal galleries that communicate with its cylindrical surface and connect by way of a chamber, located between the infeed point and the release point, with a means of generating suction, wherein the chamber is divided into two separate sections isolated one from the other, both of which communicate with the means of generating suction, the chamber section positioned upstream, in relation to the rotation of the contact roller, communicating with such means of generating suction by way of a valve; and wherein use is made of means of control, including at least one transducer located at a point along the guide means for the purpose of detecting the proximity and/or correct position of each sheet of wrapping material, which are capable of triggering the closing movement of the valve, and shutdown of the work station or machine downstream of the device, and of causing at least one of two opposed components that make up the guide means to be distanced from the path of the sheets.

5. Device as in claim 1, wherein the transducer is designed to detect proximity of both the leading edge and the trailing edge of the single sheet of wrapping material.

6. Device as in claim 4, wherein means of control comprise a set of transducers ranged in a line lying at right angles to the direction of movement of the sheets of wrapping material, and designed to verify the correct alignment of the sheets themselves with respect to the guide means.

7. Device as in claim 4, wherein use is made of a diverter located in a position between that of the infeed point where the sheet joins the contact roller and that of the release point where the sheet passes to guide means downstream of the device, designed to distance the sheets of wrapping material from the device whenever the shut-off valve is closed.

8. Device as in claim 4, wherein a movable assembly interlocked to the transducer and forming part of the guide means, is pivoted, substantially at one of its ends, and shifted by an actuator that is designed to distance the assembly from an opposed fixed guide by rotating it about the axis of its pivot.

9. Device as in claim 4, wherein a movable assembly interlocked to the transducer and forming part of the guide means is distanced from the opposed fixed guide by movable supports operated by at least one actuator interlocked to means of control governed by the transducer.

10. Device as in claim 4, wherein the guide means are split into two parts disposed mutually at right angles and able to move obliquely in relation to one another by way of movable supports, and wherein one such part is interlocked to the transducer.

* * * * *